US005501561A

United States Patent [19]

Wulff

[11] Patent Number: 5,501,561

[45] Date of Patent: Mar. 26, 1996

[54] FOOT MOUNTABLE DRYWALL POSITIONING DEVICE

[76] Inventor: Lawrence H. Wulff, Site 18, Comp. 7, R.R. #4, Vernon, British Columbia, Canada, V1T 6L7

[21] Appl. No.: 377,286

[22] Filed: Jan. 23, 1995

[30] Foreign Application Priority Data

Jan. 21, 1994 [CA] Canada ..... 2113949

[51] Int. Cl.[6] ..... E04G 21/16

[52] U.S. Cl. ..... 414/11; 36/136; 254/131

[58] Field of Search ..... 36/113, 136; 254/120, 254/130, 131; 414/11

[56] References Cited

U.S. PATENT DOCUMENTS

| | | | |
|---|---|---|---|
| 756,198 | 4/1904 | Adams | 36/136 |
| 1,103,108 | 7/1914 | Van Wie | 36/113 |
| 2,692,753 | 10/1954 | Masterson, Jr. et al. | 254/131 |
| 2,989,286 | 6/1961 | Gillespie | 254/120 |
| 3,268,209 | 8/1966 | Humbyrd | 254/120 |
| 3,871,054 | 3/1975 | Schaefer | 254/131 |
| 4,693,022 | 9/1987 | Terhune | 36/136 |
| 4,712,771 | 12/1987 | Donnelly et al. | 254/131 |

*Primary Examiner*—Michael S. Huppert
*Assistant Examiner*—Janice L. Krizek
*Attorney, Agent, or Firm*—Bishop & Company

[57] ABSTRACT

A foot mountable drywall positioning device has a drywall positioning lever pivotally mounted to a structure for releasably securing the lever to a boot, the lever rotatable between a lowered drywall engaging position and a raised position. The drywall lever has a first "U"-shaped bracket having an apex end, opposed ends opposite the apex end, and a fulcrum between the apex end and the opposed ends; the apex end having a platform for releasably engaging a sheet of drywall, the opposed ends pivotally connected to the a structure for releasably securing the lever to a boot, and the fulcrum depending downwardly from the first "U"-shaped bracket so as to be engagable with a floor surface when the lever is in the lowered drywall engaging position. Where the fulcrum is engaged with the floor surface the lever may be rotated about the fulcrum by lowering the means for releasably securing the lever to a boot to thereby raise the apex end and the drywall sheet releasably engaged thereon.

4 Claims, 12 Drawing Sheets

FOOT MOUNTABLE DRYWALL POSITIONING DEVICE

FIELD OF THE INVENTION

This invention relates to the field of construction tools and in particular to a device which may be mounted to a person's foot and used to position a sheet of drywall when drywall is being installed during the construction of a building.

BACKGROUND OF THE INVENTION

Typically when sheets of conventional drywall are installed in a building, they are installed in two horizontal rows. The first row is snugged up against the ceiling and the second row snugged up beneath the first row. It is desirable to have the second lower row snugged up against the first, higher row. Also, it is desirable to have the lower-most edge of the second row of drywall, once installed, approximately three-quarters of an inch above the level of the sub-floor to prevent water damage to the drywall in the event of accidental flooding.

Levers available on the market for this purpose all suffer the drawback that they have to be put into place by hand, that is, they are had-held tools. Consequently, it is an object of the present invention to provide a tool which may be attached to a foot of the user and operated without the use of the operator's hands.

It is a further object of the invention to provide a foot operated lever, attachable to an operator's boot or shoe, which, when the tool is not in use, is rotatable up out of the way so as to be carried in an upright position on the operator's boot or shoe, and which when in a lowered position in use provides a rocker surface as a fulcrum so as to distribute the force of lifting the drywall on soft surfaces such as plywood sub-floors. The present invention also provides a robust hinging mechanism for the foot operated lever which will withstand significant forces, such as when a drywall installer places all his weight on the lever, by vertically transferring the force exerted by the installer through a hinge pin to the arm of the lever while minimizing a bending moment applied to the hinge.

Thus the present invention has advantages over the device of Humbyrd, U.S. Pat. No. 3,268,209 which issued Aug. 23, 1966 for a Roller Lift for Handling Dry-wall Panels. In particular, Humbyrd does not provide a force distributing rocker surface but rather a narrow roller wheel. Further, Humbyrd provides a hinge mechanism which must withstand a significant bending moment applied to the hinge resultant of an installer exerting vertically downwards against the device.

SUMMARY OF THE INVENTION

A foot mountable drywall positioning device has a drywall positioning lever pivotally mounted to means for releasably securing the lever to a boot. The lever is rotatable between a lowered drywall engaging position and a raised position.

In one embodiment, the drywall lever has a first "U"-shaped bracket with an apex end, opposed ends opposite the apex end, and a fulcrum between the apex end and the opposed ends. The apex end of the first "U"-shaped bracket has means for releasably engaging a sheet of drywall. The means for releasably engaging the sheet of drywall may be a lip protruding from the apex end of the lever. The opposed ends of the first "U"-shaped bracket are pivotally connected at the boot to the means for releasably securing the lever to a boot. The fulcrum of the first "U"-shaped bracket is opposed elongated rocker surfaces which depend downwardly from opposed arms of the first "U"-shaped bracket so as to be engagable with the floor surface when the lever is in the lowered drywall engaging position.

When the fulcrum is engaged with the floor surface, the lever may be rotated about the fulcrum by lowering the means for releasably securing the lever to a boot to thereby raise the apex end and the drywall sheet releasably engaged thereon.

The means for releasably securing the lever to a boot may have a second "U"-shaped bracket for snug fitment around a heel of the boot and a strap for securing the first "U"-shaped bracket to the boot.

The second "U" -shaped bracket may have side members, the side members having channel members for receiving the opposed ends of the first "U"-shaped bracket therein, the opposed ends pivotally connected to the channel members by opposed hinges on either side of the boot when the "U"-shaped brasket is installed on the boot.

Advantageously, the lever and the means for releasably securing the lever to a boot further have means for releasably securing the lever in the lowered drywall engaging position and in the raised position. The means for releasably securing the lever in the lowered drywall engagement position and releasably securing the lever in the raised position may comprise horizontal and inclined grooves, respectively, on the opposed ends of the first "U"-shaped bracket for mating engagement with a flange protruding from the channel members.

DETAILED DESCRIPTION OF PREFERRED EMBODIMENTS

Figure 1:
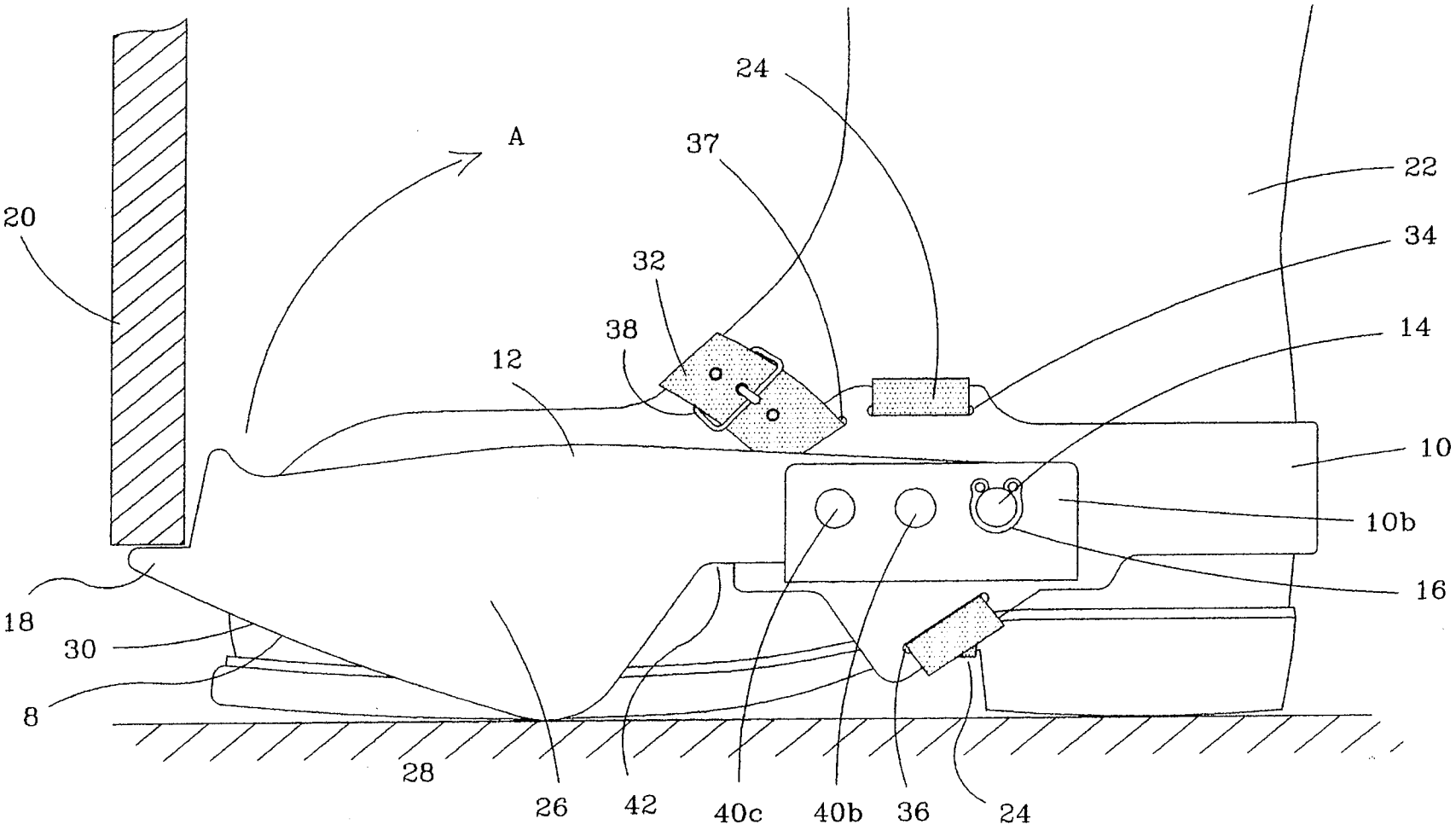
FIG. 1 is, in side elevation view, the drywall positioning device of the present invention mounted on a boot.

Illustrated in FIG. 1 is a drywall lifting and positioning device of the present invention. The device has two main components, a boot encircling bracket 10 and a drywall platformbracket 12. Drywall platform bracket 12 is pivotable about boot encircling bracket 10 on pivot pin 14, retained in place through boot encircling bracket 10 and drywall platform bracket 12 by clip 16. Drywall platform bracket 12 has drywall platform 18 for vertically supporting a sheet of drywall 20 and opposed fulcrums 26 extending rearwardly of platform 18 along the opposed arms of bracket 12.

When it is desired to raise and position a sheet of drywall 20, drywall platform 18 is inserted under the lowermost edge of drywall 20 and downwards pressure applied by the operator pressing boot 22 downwards against strap 24. The weight of drywall sheet 20 forces fulcrum 26 downward so as to engage floor 28. Downwards pressure on strap 24 rotates drywall platform bracket 12 about rocker surfaces 30 on fulcrums 26 so as to raise drywall platform 18 thereby raising drywall sheet 20. Rocker surfaces 30 extend from platform 18 rearwardly in a gentle downwardly convex curved surface. In the preferred embodiment the curve of rocker surfaces 30 approximates a circular section having a curvature ratio of 44:1 (length:variance from a straight line) centered about points B medial along rocker surfaces 30.

When not in use, drywall platform bracket 12 may be rotated upwards in direction A about pivot pin 14 into an upright carrying position which may be anywhere between fortyfive degrees and substantially vertical. For carrying drywall platform bracket 12 when in this position, strap 32 is provided to secure boot encircling bracket 10 to boot 22. Drywall platform bracket 12 may be contoured so as to snugly and conformally fit against an operator's leg when in the upright position.

Strap 24 is threaded through aperture 34 and may be secured at that point. Similarly, strap 32 is threaded through aperture 36 and may be secured at that point. Strap 32 may also be threaded through aperture 37 to help hold strap 32 in position. Strap 24 and strap 32 may be one continuous piece of strapping, so that instead of strap 24 being secured at aperture 34 and strap 32 being secured at aperture 36, strap 24 would continuously travel down between boot 22 and boot encircling bracket 10 from aperture 34 to aperture 36 at which point it would loop back on itself after being threaded through aperture 36 so as to form strap 32. Strap 32 may have a releasable closure such as buckle 38 or like releasable fastener for snugly securing boot encircling bracket 10 on boot 22.

Figure 2:
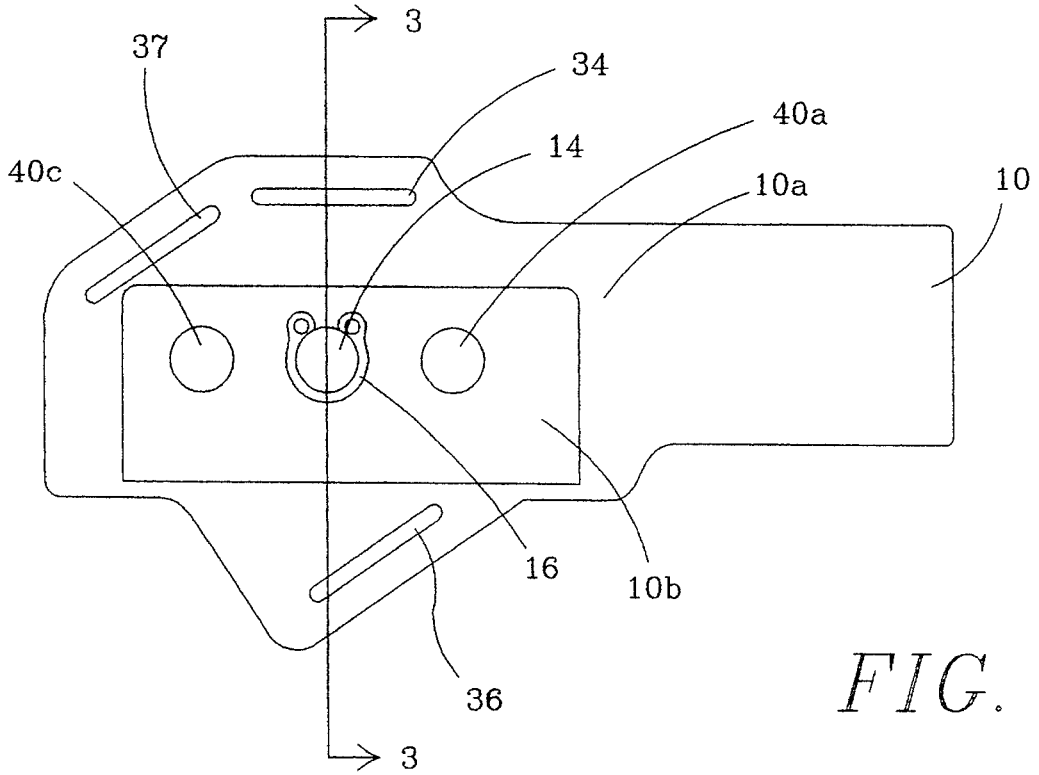
FIG. 2 is, in side elevation view, a boot encircling bracket.

As illustrated in FIG. 1, pivot pin 14 may be inserted through pivot pin hole 40*a* (pin hole 40*a* better seen in FIG. 2). In order to accommodate larger sizes of boot 22, pivot pin 14 may be alternatively through pivot pin holes 40*b* or 40*c*, preferably keeping pivot pin 14 in proximity to the heel of boot 22 to minimize the bending moment about pivot pin 14 when drywall 20 is being raised.

FIG. 2 illustrates boot encircling bracket 10 in isolation. Pivot pin 14 is illustrated as inserted in pivot pin hole 40*b* and retained therein by clip 16.

Figure 3:
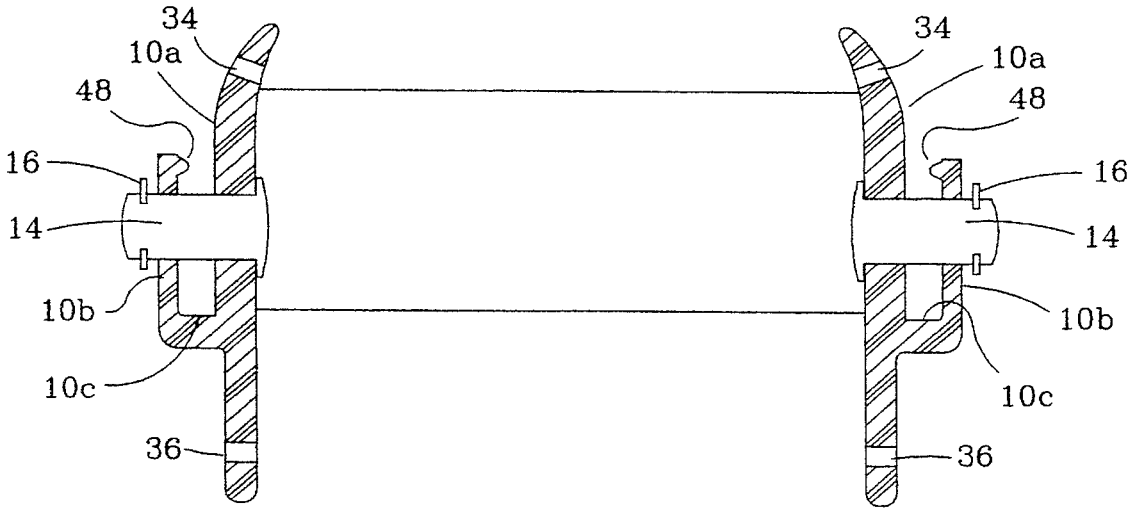
FIG. 3 is a cutaway view along line 3—3 in FIG. 2 of the boot encircling bracket of FIG. 2.
Figure 4:
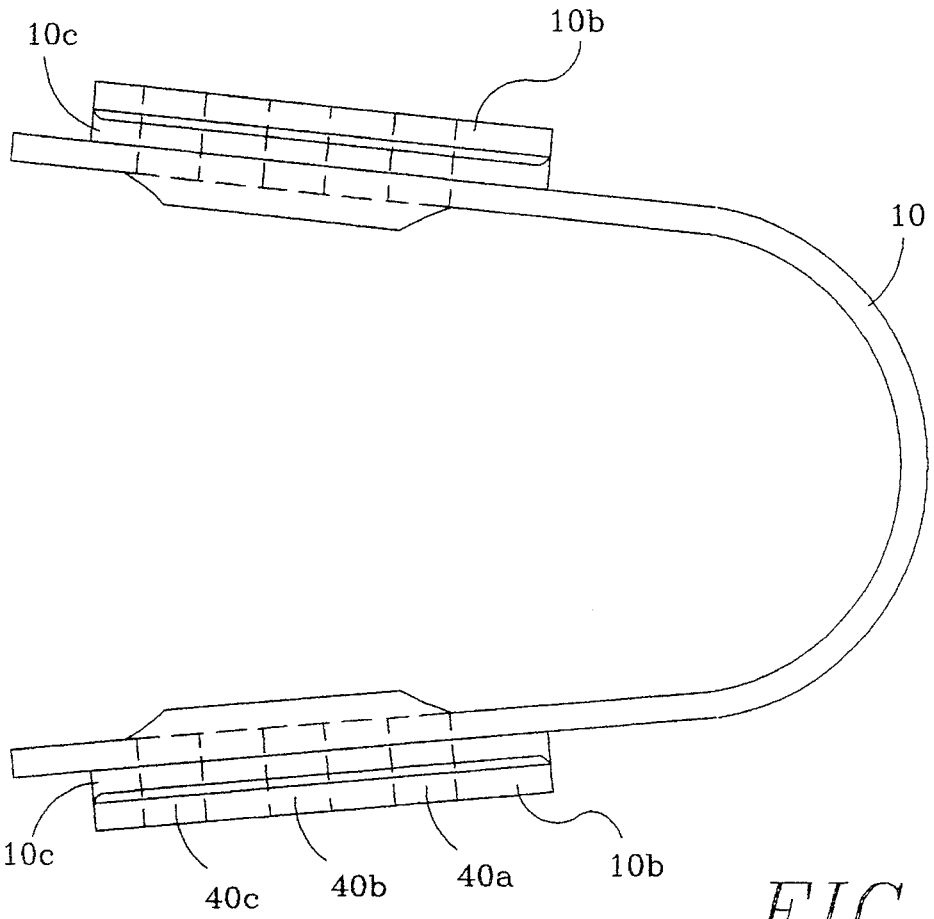
FIG. 4 is the boot encircling bracket of FIG. 2.

As illustrated in FIG. 3, which is a cross section along line 3—3 illustrated in FIG. 2, pivot pins 14 extend through channels on each side, one on each side, of boot encircling bracket 10. The channels are formed between main bracket members 10*a* and outside channel flanges 10*b*. Lower interior channel surface 10*c* provides a bearing surface for pressure surface 42 along the lower rear edge of drywall platformbracket 12 when drywall platform bracket 12 is in its' lowered position. As illustrated in FIG. 4, boot encircling bracket 10 is "U"-shaped to snugly fit around boot 22.

Figure 5A:
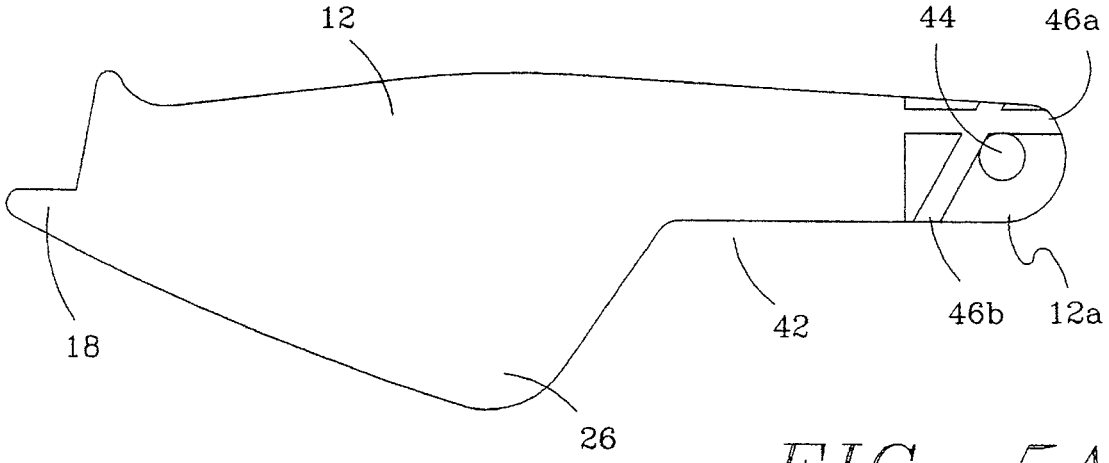
FIG. 5*a* is, in side elevation view, a drywall platform bracket.
Figure 5B:
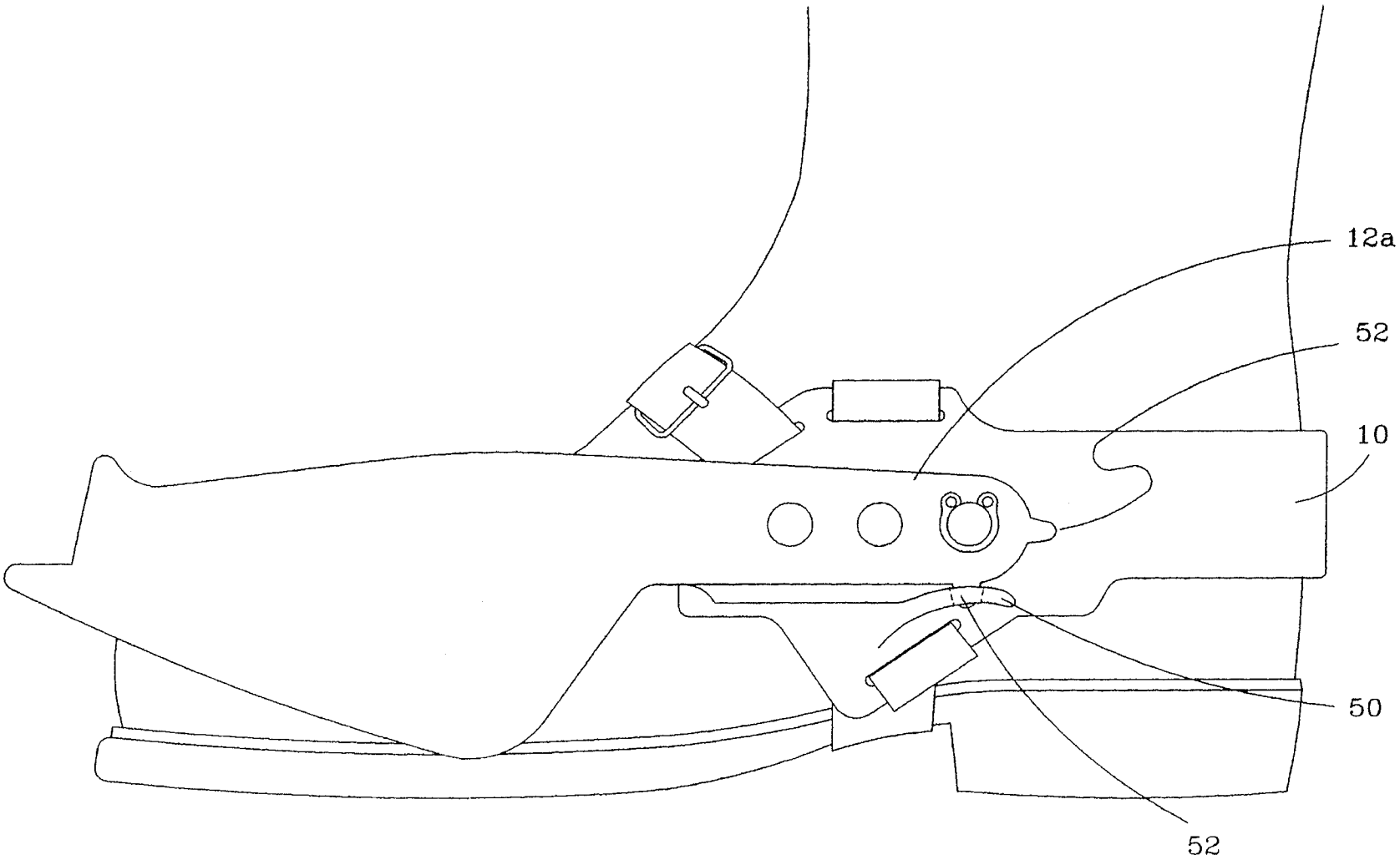
FIG. 5*b* is, in side elevation view, an alternative embodiment of a bracket end of the drywall platform bracket of FIG. 5*a*.
Figure 6:
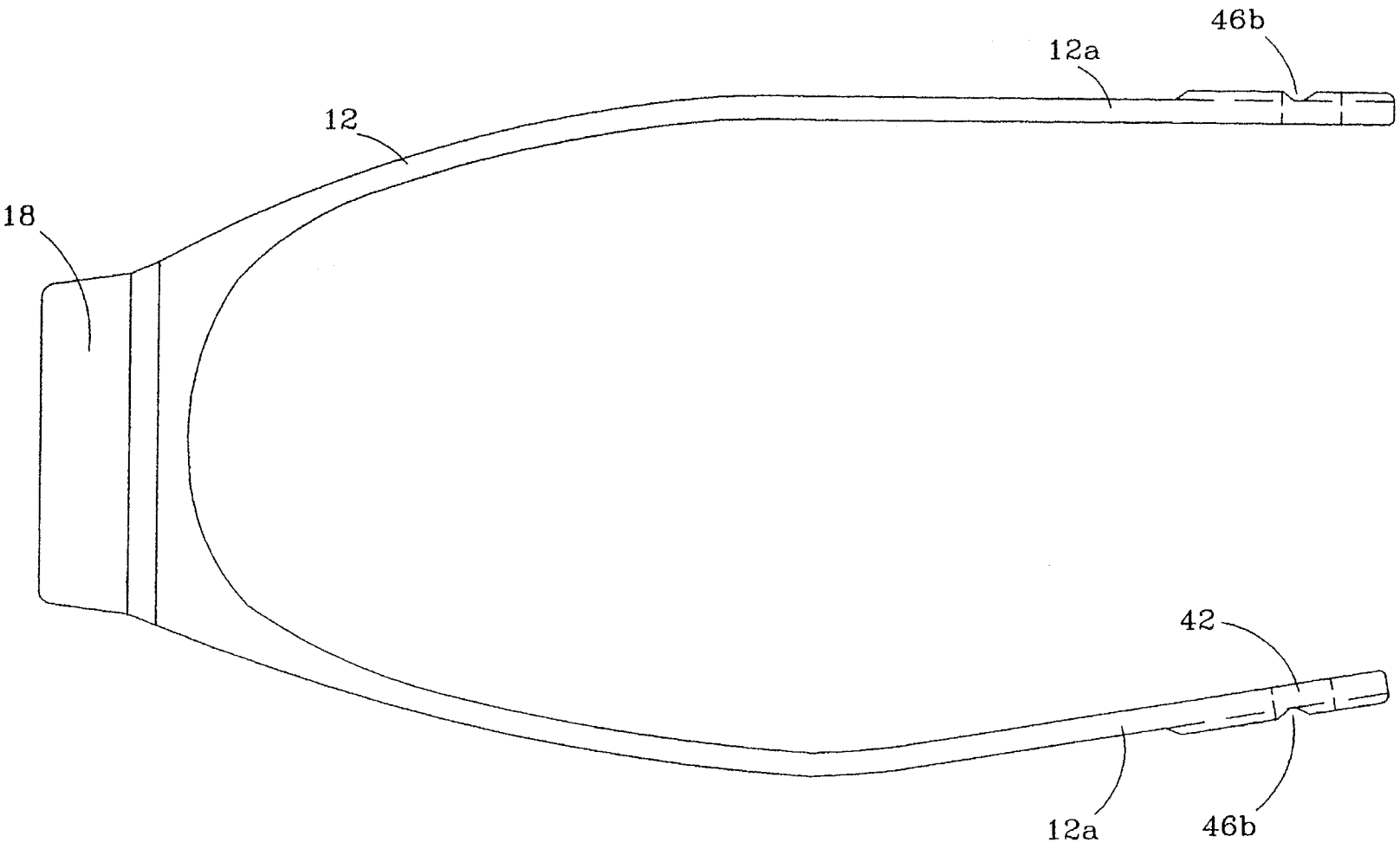
FIG. 6 is, in plan view, the drywall platform bracket of FIG. 5*a*.

In FIGS. 5 and 6, drywall platform bracket 12 is illustrated in side and plan view, respectively. Pivot pin hole 44 accepts pivot pin 14 snugly therethrough. Bracket ends 12*a* fit snugly between main bracket members 10*a* and outside channel flanges 10*b* so that, when bracket 12 is in its' lowered position, pressure surface 42 rests along lower channel surface 10*c*.

Bracket ends 12*a* have on their outermost surfaces horizontal groove 46*a* and inclined groove 46*b*. When drywall platform bracket 12 is in its' horizontal position, groove engaging ridge 48 is engaged in horizontal groove 46*a*. When drywall platform bracket 12 is rotated in direction A into its' raised position, groove engaging ridge 48 is forced out of horizontal groove 46*a*, channel wall 10*b* resiliently flexing to allow this. Groove engaging ridge 48 snaps into inclined groove 46*b* when drywall platform bracket 12 is rotated into its' raised position (not shown). Groove engaging ridge 48 mating in horizontal groove 46*a* and inclined groove 46*b* releasably secures drywall platform bracket 12 in its' horizontal and raised positions respectively.

Alternatively, as illustrated in FIG. 5*b*, platform bracket 12 could be locked in position using a flexible tab 50 attached to the boot bracket having a hole in its' top surface (shown in dotted outline) to engage protruding knobs 52 around the circumference of bracket ends 12*a*.

Figure 7A:
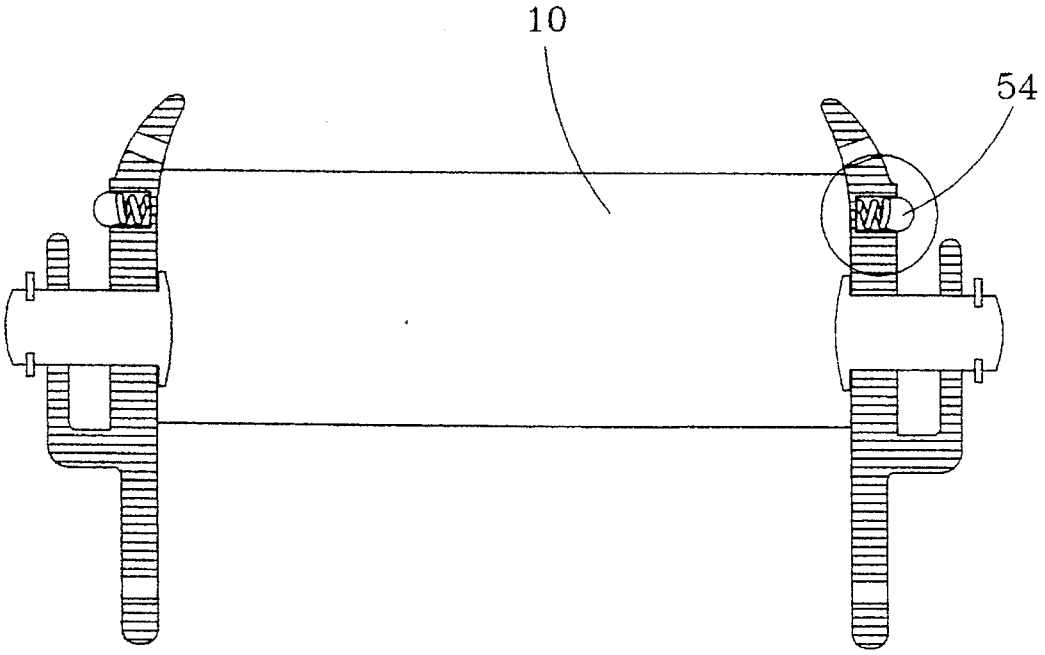
FIG. 7*a* is, in cutaway view along line 3—3 in FIG. 2, a drywall platform bracket pivotally mounted in a boot encircling bracket.
Figure 7B:
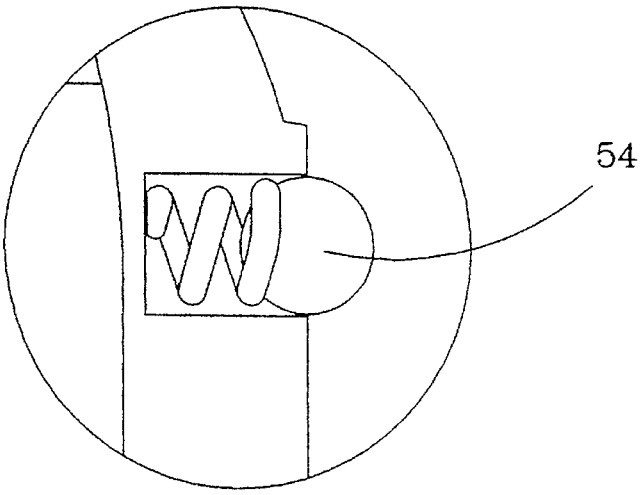
FIG. 7*b* is a detailed view of the detent ball of FIG. 7*a*.

Alternatively, as illustrated in FIG. 7*a*, detailed in FIG. 7*b*, platform bracket 12 could be locked in position with the aid of a spring loaded detent ball 54 in bracket 10 engaging a detent in bracket 12 (not shown).

Figure 8:
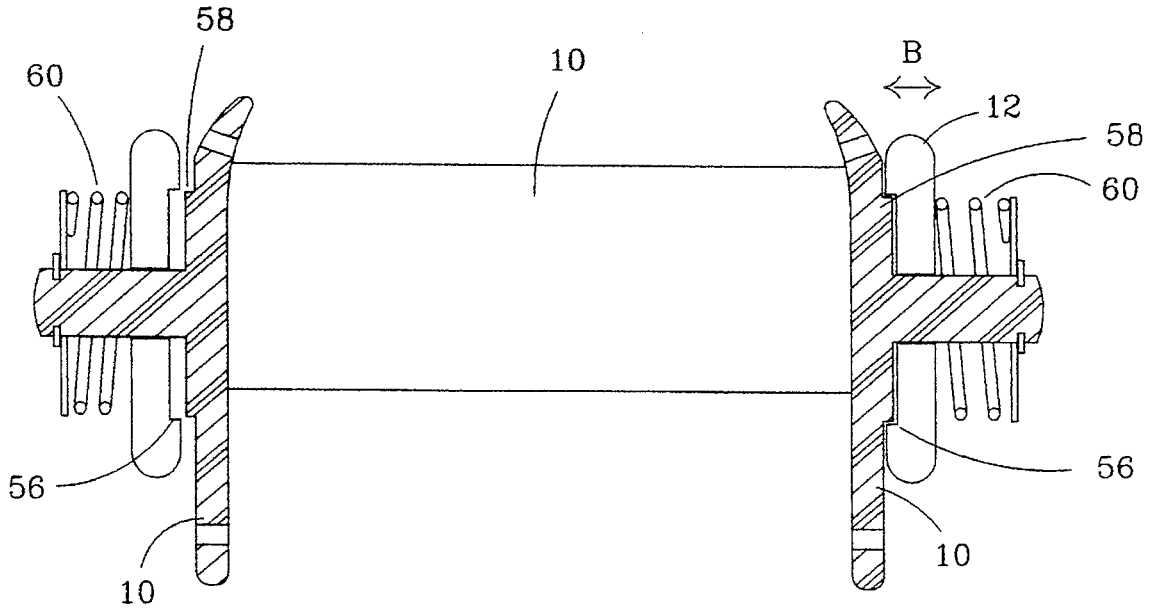
FIG. 8 is, in cutaway view along line 3—3 in FIG. 2, a drywall platform bracket pivotally mounted in a boot encircling bracket.

Alternatively, as illustrated in FIG. 8, platform bracket 12 could have grooves 56 provided on the innermost surfaces of bracket 12 to align with flanges 58 on bracket 10. Brackets 10 and 12 are pressed together in direction "B" with a spring 60 anchored to the end of pivoting pin 14.

Figure 9:
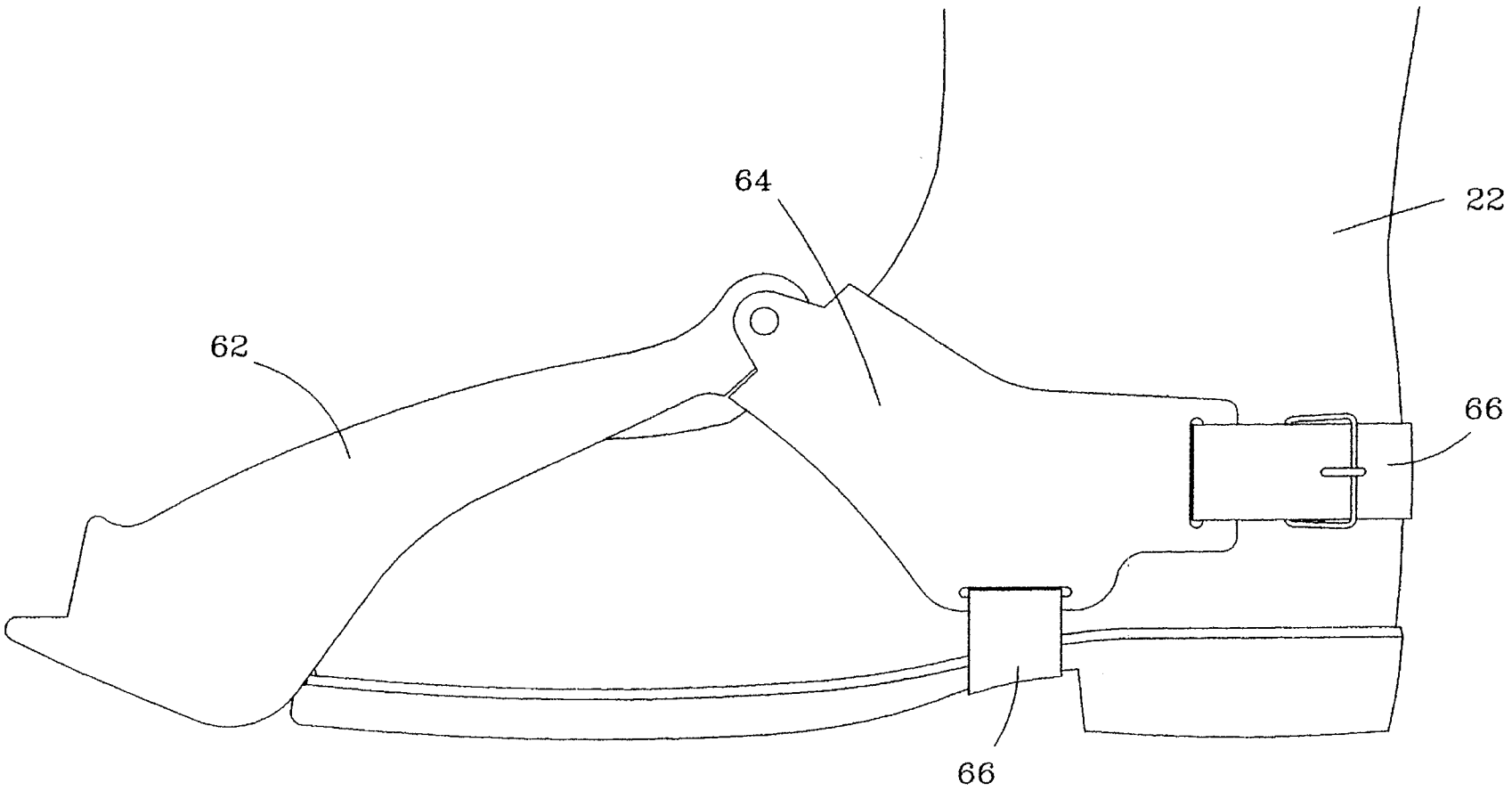
FIG. 9 is an alternative embodiment of the drywall positioning device of the present invention in side elevation view.

Alternatively, as illustrated in FIG. 9, bracket 12 might be a single lever 62 pivotally secured to a "U"-shaped saddle bracket 64, saddle bracket 64 being secured to boot 22 by securing straps 66.

Figure 10:
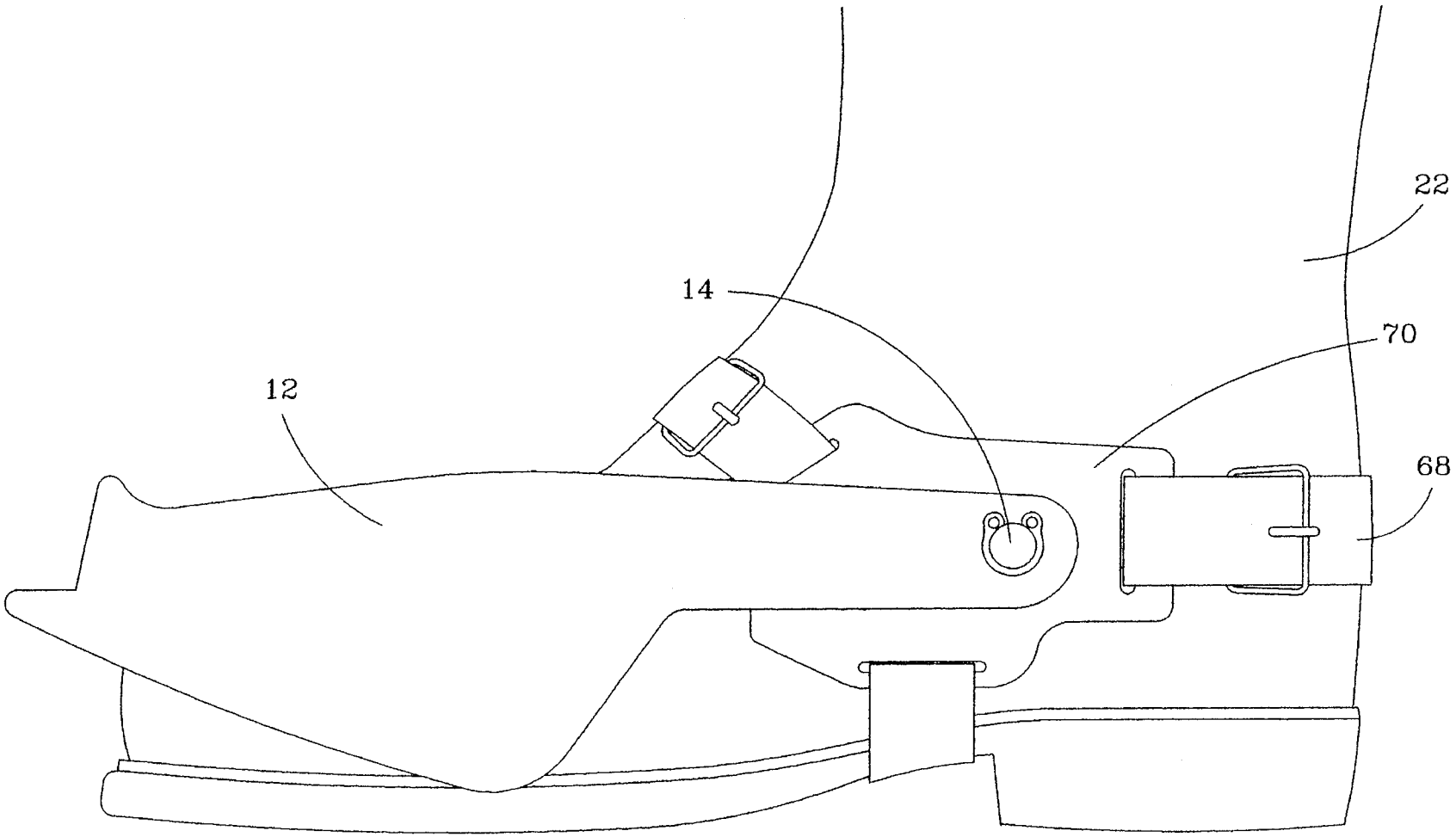
FIG. 10 is an alternative embodiment of the drywall positioning device of the present invention.

Alternatively, as illustrated in FIG. 10, boot encircling bracket 10 may be replaced by securing straps 68 and anchor plate 70.

Figure 11:
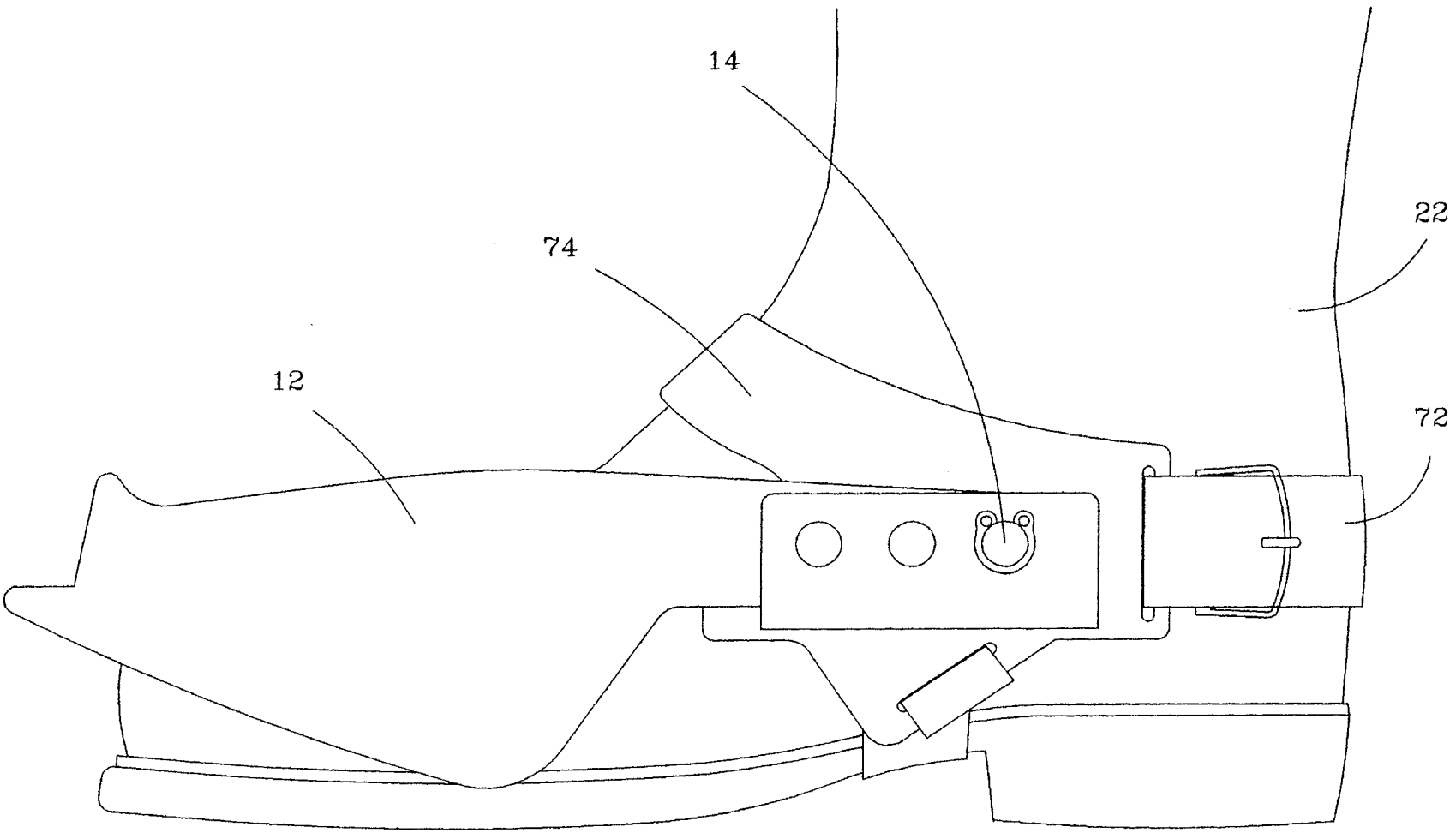
FIG. 11 is an alternative embodiment of the drywall positioning device of the present invention.

Alternatively, as illustrated in FIG. 11, boot encircling bracket 10 and strap 32 may be replaced with strap 72 and "U"-shaped saddle bracket 74, respectively.

Figure 12:
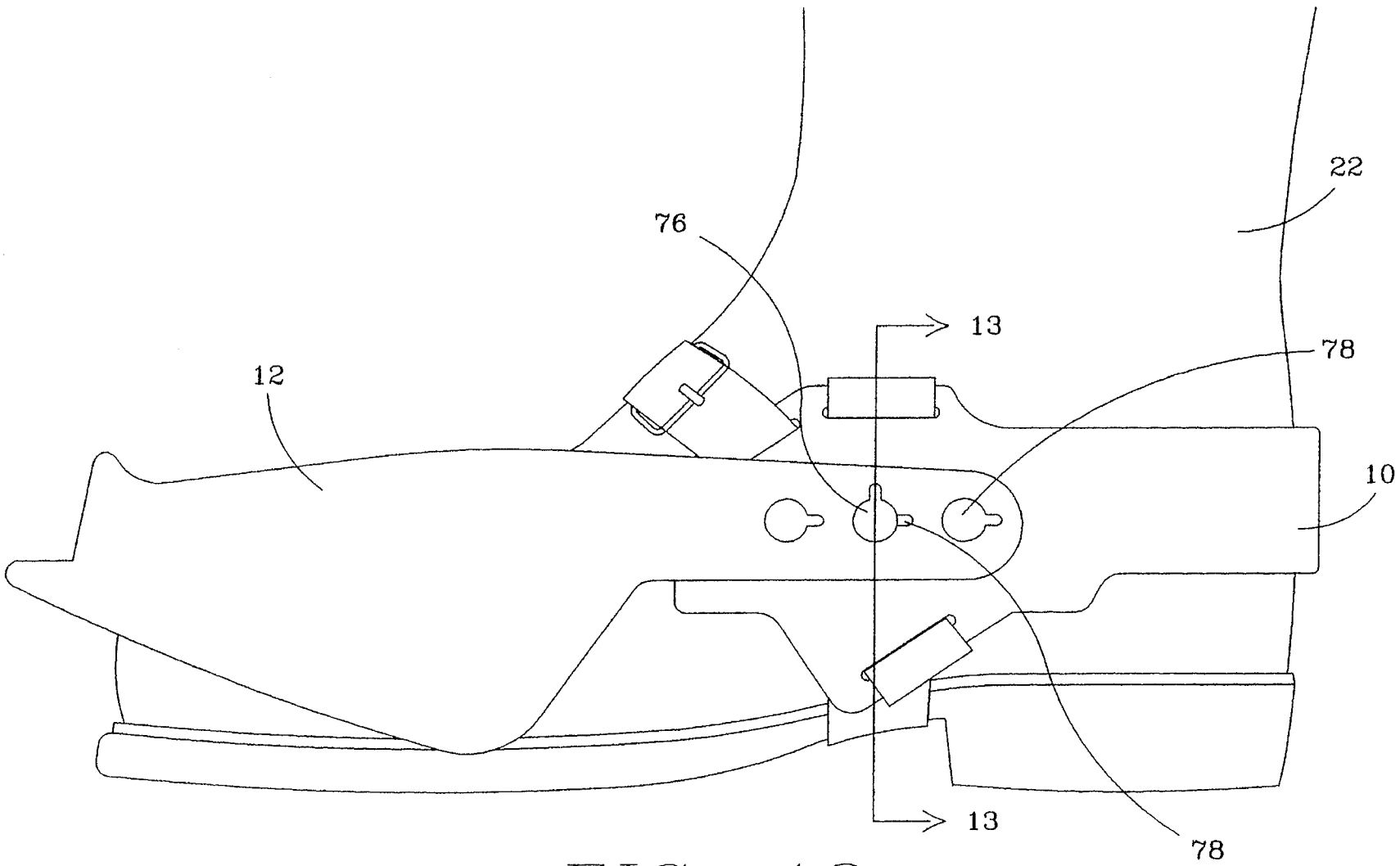
FIG. 12 is an alternative embodiment of the pivot pin of FIG. 1.
Figure 13:
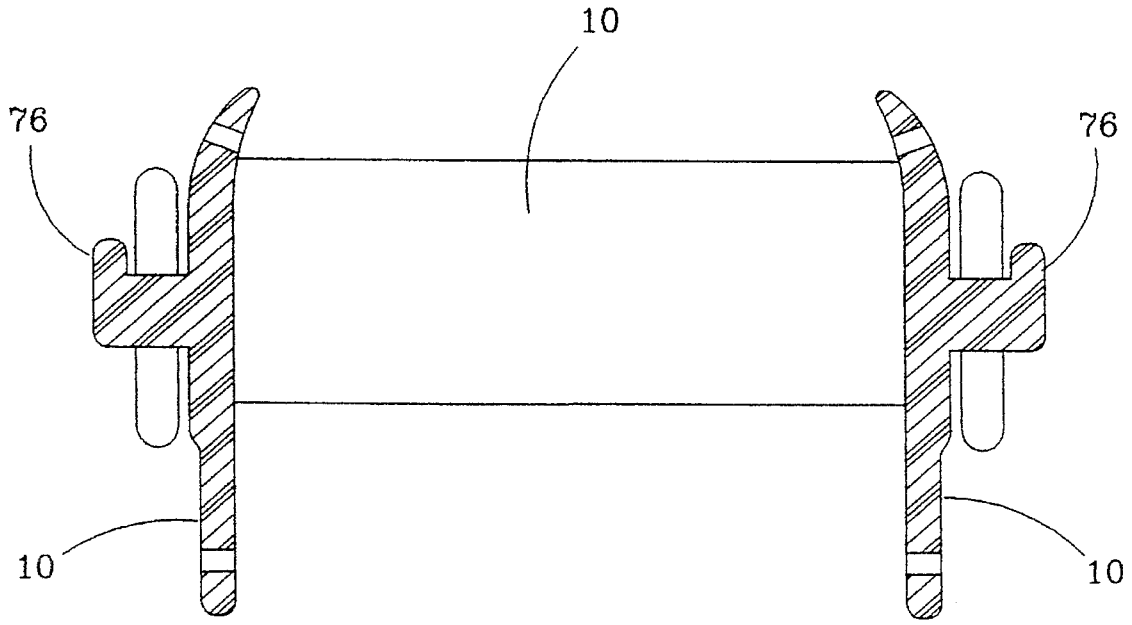
FIG. 13 is a cutaway view along line 13—13 in FIG. 12.

Alternatively, as illustrated in FIGS. 12 and 13, pivot pin 14 and clip 16 could be replaced by hooked pin 76. hooked pin 76 allows bracket 12 to be easily mounted on bracket 10 by passing the hooked end of hooked pin 76 through key-hole opening 78.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A foot mountable drywall positioning device comprising a drywall positioning lever pivotally mounted to means for releasably securing said lever to a boot, said lever rotatable between a lowered drywall engaging position and a raised position, said lever rotatable about pivot means on said means for releasably securing said lever to a boot, said drywall lever comprising a first "U"-shaped bracket having an apex end, opposed ends opposite said apex end, and a fulcrum between said apex end and said opposed ends, said apex end having means for releasably engaging a sheet of drywall, said opposed ends pivotally connected to said pivot means on said means for releasably securing said lever to a boot, said fulcrum comprising opposed elongated rocker surfaces depending downwardly from said first "U"-shaped bracket rearwardly of said apex end so as to be engagable with a floor surface when said lever is in said lowered drywall engaging position, and said pivot means disposed on either side of a boot, in proximity to a heel on said boot, when said foot mountable drywall positioning device is mounted on said boot, whereby when said fulcrum is engaged with said floor surface said lever may be rotated about said opposed elongated rocker surfaces by lowering said means for releasably securing said lever to a boot to thereby raise said apex end and said drywall sheet releasably engaged thereon.

2. The device of claim 1 wherein said lever and said means for releasably securing said lever to a boot further comprise means for releasably securing said lever in said lowered drywall engaging position and means for releasably securing said lever in said raised position.

3. The device of claim 2 wherein said means for releasably securing said lever to a boot comprises a second "U"-shaped bracket for snug fitment around said heel of said boot, said second "U"-shaped bracket having side members, said side members further comprising channel members for receiving said opposed ends of said first "U"-shaped bracket therein, said opposed ends pivotally connected to said channel members, said second "U"-shaped bracket having a strap for securing said first "U"-shaped bracket to said boot.

4. The device of claim 3 wherein said means for releasably securing said lever in said lowered drywall engaging position and releasably securing said lever in said raised position comprises horizontal and inclined grooves respectively on said opposed ends of said first "U"-shaped bracket for mating engagement with a flange protruding from said channel members.

* * * * *